US009259773B2

(12) United States Patent
Frigo

(10) Patent No.: US 9,259,773 B2
(45) Date of Patent: Feb. 16, 2016

(54) PROCEDURE FOR THE DYNAMIC CORRECTION OF THE BENDING ANGLE OF SHEET METAL ON A PANEL BENDER MACHINE

(75) Inventor: Andrea Frigo, Rovereto (IT)

(73) Assignee: FINN-POWER ITALIA S.R.L., Cologna (IT)

( * ) Notice: Subject to any disclaimer, the term of this patent is extended or adjusted under 35 U.S.C. 154(b) by 232 days.

(21) Appl. No.: 14/003,257

(22) PCT Filed: Mar. 2, 2012

(86) PCT No.: PCT/IB2012/051008
§ 371 (c)(1),
(2), (4) Date: Sep. 5, 2013

(87) PCT Pub. No.: WO2012/120429
PCT Pub. Date: Sep. 13, 2012

(65) Prior Publication Data

US 2013/0340494 A1 Dec. 26, 2013

(30) Foreign Application Priority Data

Mar. 7, 2011 (IT) ..... VR2011A0045

(51) Int. Cl.
*B21D 5/04* (2006.01)
*B21D 5/00* (2006.01)

(52) U.S. Cl.
CPC ..... *B21D 5/004* (2013.01); *B21D 5/006* (2013.01); *B21D 5/045* (2013.01)

(58) Field of Classification Search
CPC ..... B21D 5/004; B21D 5/006; B21D 5/045
See application file for complete search history.

(56) References Cited

U.S. PATENT DOCUMENTS 5,367,902 A * 11/1994 Kitabayashi et al. ..... 72/37
5,488,470 A * 1/1996 Ooenoki ..... 72/37

(Continued)

FOREIGN PATENT DOCUMENTS

DE 4312565 A1 10/1994
EP 1410855 A1 4/2004

(Continued)

OTHER PUBLICATIONS

International Search Authority, Search Report for International Application PCT/IB2012/051008, Apr. 26, 2012, (EPO), 2 pages, The Hague, Netherlands.

*Primary Examiner* — David B Jones
(74) *Attorney, Agent, or Firm* — Ference & Associates LLC

(57) ABSTRACT

Described is a procedure for bending a sheet of sheet metal on a panel bender machine wherein upon bending the sheet of metal sheet a first software (BE) for machine control transmits to a second software (VS) for management of a TV camera (17), positioned in alignment with the bending line, the data relating to the nominal bending angle, the bending length, the distance of the bent edge from the center line of the panel bender and the thickness of the metal sheet. The second software (VS) acquires an image of the bent metal sheet, identifies the spatial position of the straight line corresponding to the bent edge of the sheet of sheet metal and then calculates its geometric coordinates in accordance with a preset referencing system, and supplies to the first software (BE) the value of the angle of the bend performed. The machine control is returned to the first software (BE), which calculates the difference between the angle of the bend actually performed and the angle of the nominal bend and then orders the start of a new bend corresponding to the angular difference, thereby obtaining a bend corresponding to the nominal bend.

7 Claims, 1 Drawing Sheet

(56) References Cited

U.S. PATENT DOCUMENTS

| | | | | |
|---|---|---|---|---|
| 5,531,087 | A * | 7/1996 | Kitabayashi et al. | 72/37 |
| 5,839,310 | A * | 11/1998 | Tokai et al. | 72/31.1 |
| 6,644,080 | B2 * | 11/2003 | Lindstrom | 72/19.4 |
| 7,055,355 | B2 * | 6/2006 | Codatto | 72/31.11 |
| 7,412,863 | B2 * | 8/2008 | Akami et al. | 72/31.11 |

FOREIGN PATENT DOCUMENTS

| | | | |
|---|---|---|---|
| JP | 2280920 | A1 | 11/1990 |
| JP | 4009216 | A1 | 1/1992 |
| WO | 2004018318 | A1 | 12/2004 |

* cited by examiner

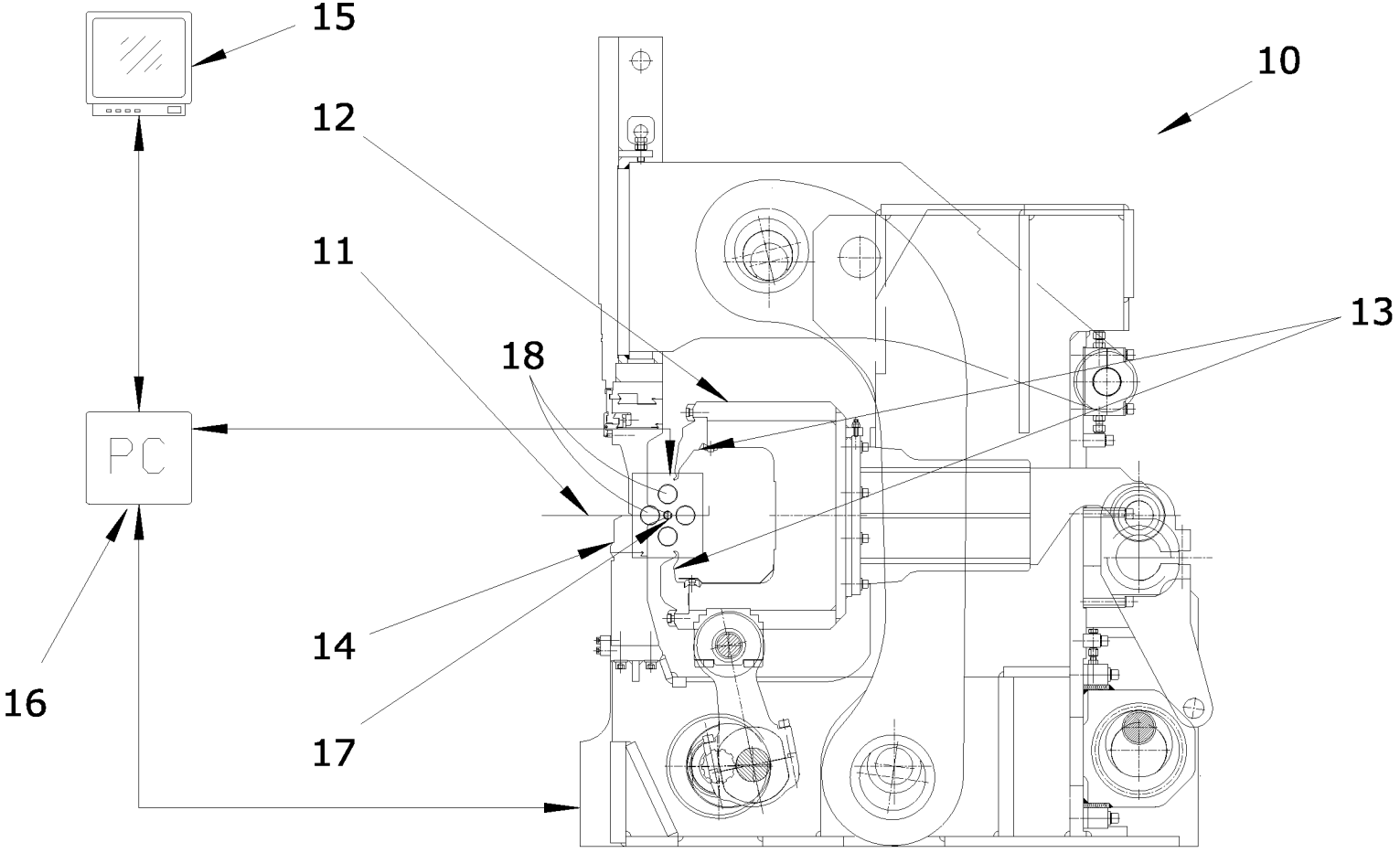
10
13
18
15
12
11
14
17
PC
16

PROCEDURE FOR THE DYNAMIC CORRECTION OF THE BENDING ANGLE OF SHEET METAL ON A PANEL BENDER MACHINE

TECHNICAL FIELD

This invention relates to a procedure for bending sheet metal on a panel bender machine.

More specifically, this invention relates to a procedure by which it is possible to bend metal sheets in an extremely precise manner, using a unit which is able to perform, in a fully automatic manner, digital processing of the bends and to correct, again automatically, the bends the angles of which differ from the preset nominal bending angles.

The invention is mainly applied in the field of panel bender machines for making metal sheet profiles.

BACKGROUND ART

It is known that panel bender machines are used in the industry for the manufacture of metal sheet products which allow a succession of bends to be made on the same metal sheet, in such a way as to obtain a finished product such as, for example, the hood of a cooker or the shelf of a stand.

It is also known that the panel bender machines or metal sheet benders normally consist of:

- a fixed workbench for supporting the material, for example a metal sheet, to be bent;
- a supporting frame for a clamping press;
- a punch or presser, forming part of the press, and a corresponding counterpunch or counterblade, being designed to clamp the material during the bending process;
- one or more auxiliary elements, inserted manually or automatically, commonly called auxiliary tools, forming part of the press, to be positioned between the punch and the corresponding counterpunch or counterblade, made specially and designed to clamp the material during the bending process of special parts;
- one or more bending blades which can move during use towards the material being processed;
- suitable mechanisms for moving the bending blade or blades along the workbench for shaping the part clamped between the punch and the counterpunch;
- suitable mechanisms for moving the punch which allow the clamping and release of the metal sheet, also in the presence of auxiliary tools, guaranteeing a pressing force always corresponding to the length and thickness to be bent;
- means for feeding the metal sheet, or profile, towards the blades during the work cycle;
- transducers and sensors of various types for process control, connected to an electronic control unit designed to control the production process.

A panel bender machine of the known type described above, marketed by the Applicant, comprises a C-shaped blade holder structure, which is able to move according to two directions reciprocally at right angles to the fixed workbench, on which the bending blade or blades is/are fixed.

The profile of the bend obtainable with a prior art panel bender is not only the typical 90° profile obtainable with a manual bender. The simultaneous control of the positioning of the metal sheet and the pressure exerted on it makes it possible to obtained radiused profiles.

The use of conventional blades, special tools and dies, the intervention of which is likewise inserted in the bending cycle, makes it also possible to obtain special profiles, without the need for intervention of the operator with changes to the length or the special tool used.

The blades, according to the conventional construction concept, are, as stated above, supported by a C-shaped load-bearing structure mounted on the main frame and the unit comprises two blades: the upper one for making negative bends (downwards), and the lower one for positive bends (upwards).

The system controls the size of the angles and the thickness of the metal sheet, adjusting the position of the blades using electric motors. All the movements are also executed by electric motors. A special mechanism guarantees the parallelism of the bending unit movements.

The upper punch or presser element is sectional for obtaining the size adequate for the part to be processed and contractable so as to allow the extraction of the part processed. It is mounted on an electro-welded structure with four arms hinged in the rear part of the main frame.

Thanks to the action of suitable mechanisms each segment may be released and repositioned extremely easily, since a trigger prevents the falling from the tool holder bar.

The movements of the C-shaped structure and of the upper tool are caused by hydraulic cylinders or by electric motors.

The cylinders, or the electric motors, are controlled in position by a suitable system (numerical control or other system) so as to allow the highest precision during all the bending phases.

In the conventional hydraulic panel bender machines, as in other panel bender machines present on the market, there is a kinematic structure which causes and controls the movement of the blade holder unit.

This structure may in some cases be of the pentalateral type, that is, consisting of a closed kinematic chain with five members connected by five kinematic pairs.

In the hydraulic machines, the conventional kinematic chain of the pentalateral type is, however, used for providing twisting rigidity to the machine and, therefore, not with specific mechanical functions.

With patent application PCT/IT2004/000581 the same Applicant has described a particular kinematic chain with two degrees of freedom, allowing the electrical actuation of the bending blades.

The same Applicant has also introduced onto the market a series of panel bender machines characterised by the electrical actuation of the bending axes and control of the punch/presser, that is, of all the axes which deliver torques and absorb significant outputs exploiting the above-mentioned invention.

This series of machines has the following features:

- reduced energy consumption (less than half that of a corresponding hydraulic machine);
- quieter and greater environmental protection;
- better control of the pressing and bending axes with consequent improved results in terms of finish of the component;
- better performance in terms of speed and cycle times compared with that of the machines on the market.

Patent document EP-A-1410855 describes a bender machine which, using a TV camera, a display and suitable software, allows measurement of a real bending angle, comparison with a nominal bending angle, calculation of the angle of deviation between the real angle and the nominal angle, and calculation of a new real bending angle which, taking into account the deviation, makes the real bending angle coincide with the nominal bending angle as far as possible.

More specifically, the procedure described above is performed by representing the first real angle on the display, positioning on the display a first reference indicator, calculating the angle of deviation and fixing a new bending angle which takes into account the above-mentioned angle of deviation.

The above-mentioned operations are specifically performed on the display by a skilled operator who, once the image has been taken by the TV camera of the first bend made, which is shown on the display, overlaps on the display a line representing the nominal bending angle of the metal sheet, calculates the angle of deviation and enters the new bending angle in the work program in order to obtain a metal sheet bent at an angle as close as possible to the nominal bending angle.

It may be noted that the system in the above-mentioned patent application does not execute any processing of the images, and does not obtain from them any additional information, and limits itself to showing them on the display and drawing on them a line corresponding to the desired bending angle.

On the other hand, the system in the above-mentioned patent application requires the intervention of an operator who, on the basis of his/her professionalism and experience, assesses the angular differences on the display and enters in the system the most suitable angular corrections.

For this reason, the system appears confused, laborious, slow and susceptible to errors in the manual procedure at the basis of its operation.

DESCRIPTION OF THE INVENTION

This invention proposes to overcome the typical drawbacks and disadvantages of the prior art, and to provide a procedure for bending metal sheet on a panel bender machine which, avoiding the use of a display and manual actions, allows high precision bends to be made in a fully automatic manner.

This is achieved by means of a procedure having the characteristics described in claim 1.

The dependent claims describe particularly advantageous embodiments of the procedure according to this invention.

The procedure according to this invention is implemented using a TV camera which is able to acquire a digital image of the bend made, and suitable software for digital processing of the image which is able calculate, in a fully automatic manner and without requiring the graphical representation of the bend on a display, the deviation relative to a nominal bending angle and to give a command to the machine control PLC for repositioning the bending blades of the panel bender in such a way as to obtain a bending angle substantially identical to the nominal bending angle.

In this way, any representation of the real and nominal bending lines on the display is avoided, as is the manual intervention of the operator, thereby shortening in a substantial manner the bending times of the metal sheet and improving the bending precision.

DESCRIPTION OF THE DRAWINGS

The invention is described below with reference to the FIGURE in the attached drawing, provided as a non-binding example, which shows a basic layout of the system on which this invention is based.

DESCRIPTION OF ONE EMBODIMENT OF THE INVENTION

The FIGURE shows a panel bender machine 10 for bending a metal sheet 11 comprising a C-shaped frame 12 on which a first series of bending blades 13 and a second series of counterblades 14 are mounted.

The operation of the panel bender machine is well known in the prior art and does not require further description. It is merely necessary to recall that a suitable machine control software (BE) controls the operation of the blades and counterblades and the movements of the frame in order to obtain one or more successive bends on the metal sheet 11 according to a predetermined arrangement and therefore obtain a metal profile having a preset shape.

In this case, a suitable screen 15, integrated in a computer 16 on which the machine control software (BE) runs, represents the bending parameters which may be entered by suitable data entry means, for example a keyboard, mouse or joystick or other data entry device.

A TV camera 17, advantageously of standard resolution (for example 640×480 pixels), is installed alongside the panel bender machine 10 with the optical vision axis aligned on the extension of the bending line and orientated towards the metal sheet being bent.

The TV camera is advantageously installed at least 1 m from the closest edge of the panel bender machine. A geometrical configuration of this type minimises the perspective effects.

Moreover, at least one illuminator 18, directed towards the metal sheet with beams of directed light (for example using a series of spot lights with parabolic reflectors) is installed close to the TV camera 17, in order to illuminate the edge of the metal sheet 11 being bent and, exploiting the reflectiveness of the latter, obtain a good contrast between the edge and the background.

Advantageously, the illuminator emits a very intense luminous beam, to allow an optimum closure of the diaphragm of the TV camera 17, and therefore obtain a a large depth of field. In this way the metal sheet 11 always appears sufficiently in focus in a wide range of permissible widths.

The TV camera 17 is connected to the system control computer (for example using USB or Firewire connections) and it is controlled by this.

It is able to acquire an image of a bent metal sheet and make that image available to the computer for a digital graphical analysis performed using software suitable for this purpose.

The procedure according to this invention comprises the implementation of a cycle for measuring the bending angle. This cycle is performed as follows.

a) the panel bender machine control software (BE) commands the machine to perform a predetermined bending of the metal sheet 11;

b) after performing the bending, the control software (BE) commands the raising of the metal sheet clamping presser (not illustrated) and withdrawal of the bending blade 13, as well as the subsequent forwards movement of the metal sheet for a predetermined distance, for example 10 mm, in order to carry the bent edge to a zone free of possible disturbing elements such as the presser, blade or counterblade;

c) the illuminator 18 in then switched ON;

d) the panel bender machine control software (BE) transmits the following data to the management software (VS) of the TV camera:

nominal bending angle;

bending length;

distance of bent edge from centre line of panel bender machine;

thickness of metal sheet.

The TV camera 17 is then activated and, using its management software (VS), acquires a representative image of the bent metal sheet.

The management software (VS) of the TV camera then performs a series of successive operations which can be summarised as follows:

- cancellation from the image, by means of artificial masking, of those parts of the image, such as the counterblade and the presser, which might interfere with the search for the edge of the metal sheet;
- calculation of the position on the image of a segment corresponding to the bent edge according to the nominal data;
- shortening of this segment, and in particular the elimination of several millimeters of the segment from the part close to the bending point, because this part of the bend is not straight and is not therefore suitable for calculating the angle;
- calculating a pair of segments parallel to the segment previously identified, and spaced from it by a predetermined distance, for example 20 pixels; the zone between these two segments is considered the search zone for the edge of the bent metal sheet.

For each pixel of the segment corresponding to the nominal edge, the TV camera management software (VS) calculates an orthogonal segment passing through this pixel and reads on the image the luminosity values of all the pixels belonging to this orthogonal segment, producing a curve representative of the luminosity signal.

Also, the management software (VS) of the TV camera (17) identifies the background level on the signal, even though it may not be constant, and searches for the parts of the signal that are raised with respect to the background and whose shape may correspond to the edge of the bent metal sheet, of specified thickness.

On this part of the signal the software VS calculates the centre of gravity of the system, usually consisting of a straight line. The set of points obtained in this way are interpolated to the minimum squares to obtain the best straight line passing through these; the points which do not appear to belong to a straight line are rejected using statistical analysis techniques. A straight line is then identified for which the software VS calculates the geometrical coordinates.

The software VS then converts the coordinates of the straight line identified by the imaging unit into physical units, calculates the angle of the straight line with respect to the X axis which in the physical system is parallel to, and superimposed on, the axis of the counterblade.

After performing the above-mentioned steps, the management software (VS) of the TV camera 17 restores control to the control software (BE) of the panel bender machine 10, to which a data item corresponding to the angle measured is supplied.

The control software (BE) of the machine then commands the switching OFF of the illuminator 18 and calculates the correction to be made to the bend, where the correction corresponds to the difference between the angle measured and the nominal angle.

The control software (BE) of the machine then commands the performance of a new bend corresponding to this difference.

This is all performed automatically, without any intervention by the operator. The operation performed is not represented on the display of the panel bender machine 10.

From the above description it may be seen that the automatic procedure for bending metal sheet on a panel bender machine according to this invention allows a series of significant advantages to be achieved relative to the prior art solutions.

The procedure, after entering the data relative to the bending to be performed on the sheet of sheet metal entering the machine, is performed in a fully automatic manner and independently makes the angular corrections to be performed in order to obtain the desired nominal and design result.

This eliminates any intervention by the operator, accelerating considerably the bending times and avoiding possible assessment or data entry errors by the operator.

The invention is described with reference to a preferred embodiment. It is nevertheless clear that the invention is susceptible to numerous variations which lie within the scope of its disclosure as defined in the attached claims.

The invention claimed is:

1. A procedure for bending a metal sheet on a panel bender machine, comprising:

- supporting the metal sheet to be bent on a fixed workbench;
- clamping the metal sheet using a supporting frame for a clamping press, a presser comprising part of the press, and a corresponding counter-presser;
- moving one or more bending blades and counterblades towards the metal sheet during use
- feeding the sheet towards the blades during the work cycle;
- using transducers and sensors of various types for process control that are connected to a processor unit equipped with a first machine control software designed to control the production process;
- entering and displaying bending data connected to the processor unit;
- obtaining a digital image of the bend made on the metal sheet using a TV camera installed alongside the panel bender machine whose optical vision axis is aligned with the bending line and oriented towards the metal sheet being bent;
- processing the image using a second software for managing the TV camera, wherein during bending of the metal sheet the first software for machine control transmits to the second software for TV camera management, data relating to the nominal bending angle, the bending length, the distance of the bent edge from the centre line of the panel bender and the thickness of the sheet metal;
- acquiring an image of the bent metal sheet using the second software;
- identifying the spatial position of a straight line corresponding to the bent edge of the metal sheet;
- calculating the geometric coordinates of the straight line in accordance with a preset reference system;
- supplying to the first software a value of the angle of the bend performed;
- returning the machine control to the first software;
- calculating, using the first software, the difference between the angle of the bend actually performed and angle of a nominal bend;
- ordering the start of a new bend corresponding to the angular difference, thereby obtaining a bend which corresponds to the nominal bend;
- cancelling from the image, by means of artificial masking, those parts of the image, such as the counterblade and the presser, which might interfere with the search for the edge of the metal sheet;
- calculating the position on the image of a segment corresponding to the bent edge according to the nominal data;
- shortening this segment by eliminating several millimeters of the segment from the part close to the bending point; and calculating a pair of segments parallel to the segment previously identified, where the pair of segments are at a preset distance from the other segment by a preset measurement.

2. The procedure according to claim 1, further comprising calculating using the TV camera management software, for each pixel of the segment corresponding to the nominal edge, an orthogonal segment passing through the pixel and reads on the image the luminosity value of all the pixels belonging to the orthogonal segment and then produces a luminosity signal.

3. The procedure according to claim 2, further comprising identifying, using the management software of the TV camera, the background level on the signal and searching for the parts of the signal that are raised with respect to the background and whose shape may correspond to the edge of the bent sheet metal of the specified thickness.

4. The procedure according to claim 3, wherein on the basis of this part of the signal the management software of the TV camera calculates the focal point of the system, that is usually a straight line, the set of points obtained in this way are interpolated to the mean square deviation to obtain the best straight line passing through these, thereby identifying a straight line which the management software of the TV camera then uses to calculate the geometric coordinates.

5. The procedure according to claim 4, further comprising converting, using the management software of the TV camera, the coordinates of the straight line identified by the imaging unit into physical units; and calculating the angle of the straight line with respect to the X axis which in the physical system is parallel to, and superimposed on, the axis of the counterblade of the panel bender machine.

6. The procedure according to claim 5, further comprising restoring, using the management software of the TV camera, control to the control software of the panel bender machine, to which a data item corresponding to the angle measured is supplied.

7. The procedure according to claim 6, further comprising calculating, using the control software of the machine, the correction to be made to the bend, wherein the correction corresponds to the difference between the angle measured and the nominal angle, and then performs a new bend corresponding to this difference.

* * * * *